US012753037B2

(12) United States Patent
Harper et al.

(10) Patent No.: US 12,753,037 B2
(45) Date of Patent: Oct. 6, 2026

(54) MATERIAL ROLL FEEDER

(71) Applicant: Cricut, Inc., South Jordan, UT (US)

(72) Inventors: Pierre Harper, Boise, ID (US); Michael Nolan, Dublin (IE); Kurt Stalsberg, Salt Lake City, UT (US); Grayson Stopp, San Francisco, CA (US)

(73) Assignee: Cricut, Inc., South Jordan, UT (US)

( * ) Notice: Subject to any disclaimer, the term of this patent is extended or adjusted under 35 U.S.C. 154(b) by 814 days.

(21) Appl. No.: 18/003,027

(22) PCT Filed: Jun. 25, 2021

(86) PCT No.: PCT/US2021/039209
§ 371 (c)(1),
(2) Date: Dec. 22, 2022

(87) PCT Pub. No.: WO2021/263182
PCT Pub. Date: Dec. 30, 2021

(65) Prior Publication Data

US 2023/0271802 A1 Aug. 31, 2023

Related U.S. Application Data

(60) Provisional application No. 63/044,958, filed on Jun. 26, 2020.

(51) Int. Cl.
*B65H 35/06* (2006.01)
*B65H 16/00* (2006.01)

(52) U.S. Cl.
CPC ..... *B65H 35/06* (2013.01); *B65H 16/005* (2013.01); *B65H 2404/622* (2013.01)

(58) Field of Classification Search
CPC . B65H 35/06; B65H 16/005; B65H 2404/622
See application file for complete search history.

(56) References Cited

U.S. PATENT DOCUMENTS 4,117,753 A * 10/1978 Friddle, Sr. ..... B65H 35/0006 83/590
4,168,038 A * 9/1979 Nims ..... B65H 16/06 400/621

(Continued)

FOREIGN PATENT DOCUMENTS

CN 110844668 2/2020
CN 210366129 4/2020

OTHER PUBLICATIONS

Balzer Designs, ScanNCut DX Roll Feeder, Youtube [online], Nov. 18, 2018 [retrieved on Aug. 20, 2021]. Retrieved from: <https://youtube.com/watch?v=Djhv_a5AVgo> figures 1-9.

(Continued)

*Primary Examiner* — Omar Flores Sanchez

(57) ABSTRACT

Described herein is a material roll feeder that may be used for automatically feeding material into a machine, such as an electronic cutting machine. The roll feeder includes a first portion and a second portion. The first portion may be configured to rotatably support a roll of material and the second portion may define a channel configured to receive and guide material from the roll of material therethrough. The second portion of the roll feeder may comprise guide geometry configured to operably enable a separated section of material that has been separated from the roll of material to move over a top surface of the roll of material.

20 Claims, 9 Drawing Sheets

(56) References Cited

U.S. PATENT DOCUMENTS

| | | | | |
|---|---|---|---|---|
| 4,417,495 | A * | 11/1983 | Gordon | B26D 7/14 83/37 |
| 4,839,732 | A * | 6/1989 | Murakami | B65H 35/06 399/385 |
| 5,179,880 | A * | 1/1993 | Sherick | B65H 35/06 271/213 |
| 11,021,339 | B2 * | 6/2021 | Milbrandt | B65D 83/08 |
| 2003/0209122 | A1 * | 11/2003 | Nguyen | B65H 16/06 83/522.11 |
| 2008/0135673 | A1 | 6/2008 | Sato et al. | |
| 2012/0048086 | A1 | 3/2012 | Workman et al. | |
| 2012/0155946 | A1 | 6/2012 | Colonel et al. | |
| 2015/0344256 | A1 * | 12/2015 | Kaiser | B65H 35/002 242/562 |
| 2016/0297212 | A1 | 10/2016 | Saiga et al. | |
| 2017/0217037 | A1 * | 8/2017 | Forrer | B65H 35/06 |
| 2017/0253055 | A1 * | 9/2017 | Schütz | B41J 11/70 |
| 2018/0207953 | A1 * | 7/2018 | Schütz | B31D 1/027 |
| 2019/0033768 | A1 * | 1/2019 | Ishikura | B65H 35/06 |
| 2019/0167047 | A1 * | 6/2019 | Vegliante | A47K 10/3631 |
| 2021/0001645 | A1 * | 1/2021 | Nordhus | B26D 1/305 |
| 2021/0237492 | A1 * | 8/2021 | Watari | B65H 7/04 |
| 2022/0234852 | A1 * | 7/2022 | Miyase | B65H 1/266 |
| 2022/0402228 | A1 * | 12/2022 | Hardy | B26D 3/005 |
| 2023/0416034 | A1 * | 12/2023 | Bristow | B65H 16/005 |
| 2024/0010011 | A1 * | 1/2024 | Seki | B65H 35/06 |
| 2024/0138505 | A1 * | 5/2024 | Choi | B41J 3/4078 |
| 2024/0166463 | A1 * | 5/2024 | De Camargo | A45D 44/00 |
| 2024/0270534 | A1 * | 8/2024 | Zechner | B65H 45/14 |
| 2024/0286372 | A1 * | 8/2024 | Goodrich | B31D 5/0065 |
| 2024/0308810 | A1 * | 9/2024 | Edwards | B65H 35/0033 |
| 2024/0317532 | A1 * | 9/2024 | Perini | B65H 20/20 |

OTHER PUBLICATIONS

International Search Report and Written Opinion for International Application No. PCT/US2021/039209, mailed Oct. 22, 2021, x pages.

* cited by examiner

MATERIAL ROLL FEEDER

CROSS-REFERENCES TO RELATED APPLICATIONS

This U.S. Patent Application is a national phase, under 35 U.S.C. 371, and claims priority of International Application No. PCT/US2021/039209, filed Jun. 25, 2021, which claims the benefit of U.S. Patent Application No. 63/044,958, filed Jun. 26, 2020. The entire contents of these applications are incorporated herein by reference.

FIELD

The present invention relates generally to material roll feeder systems, methods, and apparatuses, and more particularly to material roll feeders for electronic cutting machines.

BACKGROUND

Electronic cutting machines enable crafters to create many crafting projects. Generally, materials to be cut in an electronic cutting machine are placed onto a working area of the machine where one or more tools, such as a cutting blade or other tool, cuts or alters the material as it is fed back and forth through the machine. Some projects require long sections of material, for example six feet or more, to be fed through the cutting machine to create large graphics. These long sections of material can be difficult to manage during a cutting operation, especially when the cutting operation requires the material to be fed repeatedly back-and-forth through the machine during the cutting operation.

To this end, many roll feeder devices have been developed to manage long sections of materials that are fed into electronic cutting machines. Typically, these devices include some sort of frame or housing that rotatably secures a roll of material in front of the working area of the cutting machine. The roll of material can rotate as material is drawn from the roll and into the cutting machine. However, such devices of the prior art have a number of shortcomings.

For example, roll feeders of the prior art are often difficult to align with the cutting machine to ensure proper delivery of the material onto the working area of the cutting machine. Additionally, conventional roll feeders typically do not provide solutions for managing long sections of materials that are fed not just forward but also backward through the cutting machine. Typically, material fed back out of the cutting machine toward a roll feeder either rotates the roll of material backward or causes it to partially unwind and/or fall back over and down past the roll feeder. This extra slack in material fed backward out of the cutting machine can be difficult to manage and may cause unwanted kinking or creases in the material. Also, for example, severing material from the roll after a cutting operation performed by the machine and preparing the next portion of material for a new cutting operation is not a simple or an intuitive process using conventional roll feeders.

SUMMARY

In particular, the present disclosure relates to material roll feeders that may be used for automatically feeding material into a machine, such as an electronic cutting machine. In various embodiments, a roll feeder comprises a first portion and a second portion. The first portion may be configured to rotatably support a roll of material and the second portion may define a channel configured to receive and guide material from the roll of material therethrough.

In various embodiments, the first portion defines a trough configured to receive the roll of material. The second portion of the roll feeder may be configured to be detachably couple to a cutting machine, such that the channel may be configured to operably guide the material from the roll of material to pass through the channel to a working area of the cutting machine.

In various embodiments, the second portion defines a cutting slot via which the material may be severed. In various embodiments, the roll feeder further includes a severing device coupled to the second portion of the roll feeder, wherein at least a portion of the severing device is configured to operably move within and along the cutting slot to sever the material.

In various embodiments, the second portion of the roll feeder comprises guide geometry configured to operably enable a separated section of material that has been separated from the roll of material to move over a top surface of the roll of material. In various embodiments, a downstream direction is defined from the first portion toward the second portion and an upstream direction is defined from the second portion toward the first portion, opposite the downstream direction. The cutting slot may be downstream of the first portion of the roll feeder. The cutting slot may also be open to the channel.

In various embodiments, the guide geometry comprises a shape of the channel, wherein the shape of the channel is configured to operably enable the separated section of material that is at least partially disposed within the channel to exit the channel and move in the upstream direction over the top surface of the material. For example, the second portion of the roll feeder may include an upper wall and a lower wall, the lower surface of the upper wall may define a ceiling of the channel and the upper surface of the lower wall may define a floor of the channel.

In various embodiments, the ceiling of the channel comprises a first concave portion, a first convex portion, and a first inflection region between the first convex portion and the first concave portion of the ceiling. In various embodiments, the floor of the channel comprises a second convex portion, a second concave portion, and a second inflection region between the second convex portion and the second concave portion of the floor. The first concave portion may be disposed downstream relative to the first convex portion and the second concave portion may be disposed upstream relative to the second convex portion. In various embodiments, the first inflection region is disposed upstream relative to the second inflection region. In various embodiments, the cutting slot is downstream of the first inflection region.

In various embodiments, the upper wall comprises a contact rib extending downward into the channel that forms at least a portion of the ceiling of the channel such that the contact rib at least partially contributes to the shape of the channel. The contact rib may have a convex shape that transitions to a horizontal section. In various embodiments, the contact rib comprises a first contact rib disposed on a first lateral portion of the upper wall and the upper wall comprises a second contact rib disposed on a second lateral portion of the upper wall. The first contact rib may be a first set of contact ribs and the second contact rib may be a second set of contact ribs. In various embodiments, each of the first and second set of contact ribs comprises between 2 and 10 ribs.

In various embodiments, the second portion defines a first orifice as an inlet to the channel and a second orifice as an outlet to the channel. The channel may comprise a first region, a transition region, and a second region. The first region may be just downstream of the first orifice (e.g., the first orifice is an opening to the first region), the transition region may be downstream of the first region, the second region may be downstream of the transition region, and the second orifice may be downstream of the second region (e.g., the second orifice is an opening to the second region). In various embodiments, a cross-sectional area of the channel is greatest in the transition region.

Also disclosed herein, according to various embodiments, is a roll feeder that includes a first portion configured to rotatably support a roll of material and a second portion defining a channel configured to receive material from the roll of material. The roll feeder may be configured to be detachably coupled to a cutting machine.

In various embodiments, the roll feeder includes at least one securement mechanism configured to removably secure the roll feeder to the cutting machine. For example, the at least one securement mechanism may comprise one of at least one engagement slot and at least one engagement rib disposed along a lower surface of the second portion of the roll feeder. The cutting machine may comprise the other of the at least one engagement slot and the engagement rib, wherein each slot of the at least one slot is configured to respectively receive a portion of each rib of the at least one engagement rib. In various embodiments, the roll feeder is configured to be detachably coupled to the cutting machine via a friction fit between the at least one engagement slot and the at least one engagement rib.

In various embodiments, the at least one securement mechanism is configured to reversibly secure to one or more material alignment mechanisms of the cutting machine in response to the roll feeder being detachably coupled to the cutting machine during use. In various embodiments, the roll feeder is configured to be detachably coupled to an open door of the cutting machine during use. In various embodiments, the roll feeder is configured to be removably secured to one or more raised material alignment features extending upward from a top surface of the open door of the cutting machine during use.

Also disclosed herein, according to various embodiments, is a method of cutting material in a cutting machine. The method may include removably securing a roll feeder to a cutting machine, the roll feeder comprising a first portion configured to rotatably support a roll of material and a second portion defining a channel. The method may also include urging material from the roll of material rotatably supported by the first portion of the roll feeder into and through the channel. The method may also include severing a portion of material from the roll of material to form a separated section of material.

The method may further include performing a cutting operation on the material (e.g., before severing the material). In various embodiments, performing the cutting operation on the material includes drawing the material forward and backward through the cutting machine on a working area of the cutting machine, thereby moving the material back and forth through the channel of the roll feeder. In various embodiments, the method also includes removing the separated section of material be pushing the separated section of material upstream through the channel away from the cutting machine and over the roll of material. In various embodiments, severing the separated section of material from the roll of material is performed using a severing device of the roll feeder. In various embodiments, the severing device comprises a cutting blade slidably engaged within a cutting slot disposed above and open to the channel.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Thus, although the subject matter of the present disclosure is particularly pointed out and distinctly claimed in the concluding portion of the specification, a more complete understanding of the present disclosure, may best be obtained by referring to the detailed description and claims when considered in connection with the drawing figures. Understanding that these drawings depict only typical embodiments of the disclosure and are not therefore to be considered to be limiting of its scope, the subject matter of the present application will be described and explained with additional specificity and detail through the use of the accompanying drawings, in which:

DETAILED DESCRIPTION

Figure 1:
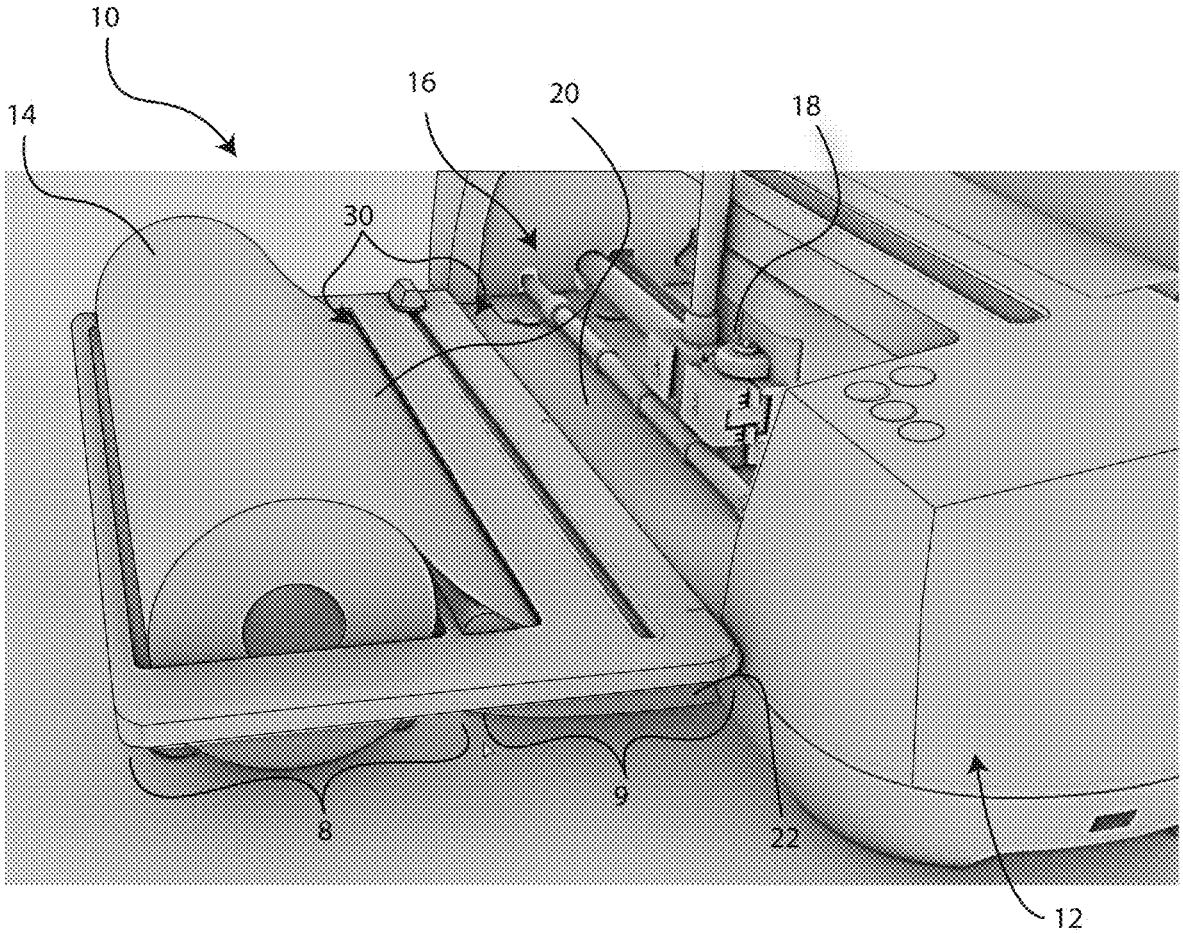
FIG. 1 illustrates a perspective view of a roll feeder shown detachably and/or removably secured to a cutting machine, in accordance with various embodiments.

The detailed description of exemplary embodiments herein refers to the accompanying drawings, which show exemplary embodiments by way of illustration. While these exemplary embodiments are described in sufficient detail to enable those skilled in the art to practice the disclosure, other embodiments may be realized and logical changes and adaptations in design and construction may be made in accordance with this disclosure without departing from the spirit and scope of the disclosure. Thus, the detailed description herein is presented for purposes of illustration only and not of limitation.

As used herein, the terms "including," "comprising," "having," and variations thereof mean "including but not limited to" unless expressly specified otherwise. Accordingly, the terms "including," "comprising," "having," and variations thereof are intended to cover a non-exclusive inclusion, such that a process, method, article, or apparatus that comprises a list of elements does not include only those elements but may include other elements not expressly listed or inherent to such process, method, article, or apparatus. An enumerated listing of items does not imply that any or all of the items are mutually exclusive and/or mutually inclusive, unless expressly specified otherwise.

Further, in the detailed description herein, references to "one embodiment," "an embodiment," "some embodiments," "various embodiments," "one example," "an example," "some examples," "various examples," "one implementation," "an implementation," "some implementations," "various implementations," "one aspect," "an aspect," "some aspects," "various aspects," etc., indicate that the embodiment, example, implementation, and/or aspect described may include a particular feature, structure, or characteristic, but every embodiment, example, implementation, and/or aspect may not necessarily include the particular feature, structure, or characteristic. Moreover, such phrases are not necessarily referring to the same embodiment, example, implementation, or aspect. Thus, when a particular feature, structure, or characteristic is described in connection with an embodiment, example, implementation, and/or aspect, it is submitted that it is within the knowledge of one skilled in the art to affect such feature, structure, or characteristic in connection with other embodiments, examples, implementations, and/or aspects, whether or not explicitly described. Absent an express correlation to indicate otherwise, features, structure, components, characteristics, and/or functionality may be associated with one or more embodiments, examples, implementations, and/or aspects of the present disclosure. After reading the description, it will be apparent to one skilled in the relevant art how to implement the disclosure in alternative configurations.

Embodiments of the present disclosure relate generally to material roll feeder systems, methods, and apparatus. In particular, the present disclosure relates to material roll feeders for electronic cutting machines. Embodiments of the present disclosure provide technical solutions to various technical problems in the art discussed above. Although numerous details and examples are included herein pertaining to roll feeders for cutting machines, the present disclosure is not necessarily so limited, as various features, components, structures, and/or functionality of the disclosed embodiments may be adapted for use and implementation in a variety of other industries. As such, numerous applications of the present disclosure may be realized.

For example, in at least one aspect of the present disclosure, a roll feeder includes attachment mechanisms that enable easy alignment with a cutting machine to ensure proper alignment and delivery of cut material onto the working area of the cutting machine. These attachment mechanisms may also enable easy removal of the roll feeder from a cutting machine.

In various embodiments of the present disclosure, a roll feeder includes a channel having a curvature and contoured features such that sections of cut material can be managed and handled gently (e.g., without damaging the material) during a cutting operation of the cutting machine. In various embodiments, the roll feeder is configured to prevent the roll of material from unwinding and/or bending or creasing when the material is fed forward and backward (i.e., into and out of the cutting machine, respectively).

In at least one aspect of the present disclosure, the disclosed roll feeder includes a cutting feature and a stop feature within a channel of the roll feeder so that once a cutting operation has been performed on a section of material, the next portion of material to be drawn from the roll of material is automatically in position and ready to be cut during a subsequent cutting operation. Additional details pertaining to the structure, features, properties, characteristics, and benefits are included below with reference to the accompanying figures.

Turning now to the figures, FIG. 1 illustrates a perspective view of a roll feeder 10 removably secured to a cutting machine 12, according to various embodiments. The roll feeder 10 generally includes a first portion 8 that is configured to rotatably support a roll 14 of material 20 and a second portion 9 that defines a channel 30 configured to receive and guide material 20 from the roll 14 therethrough. The channel 30 may guide material 20 through the channel 30 to a working area 16 of cutting machine 12. In various embodiments, a typical electronic cutting machine 12 may include a tool 18 configured to impinge upon the section of material 20 fed into the working area 16 to alter the material in some way. In various embodiments, tool 18 may comprise a blade or other cutting device that cuts at least partially through material 20 within working area 16.

In at least one other embodiment, tool 18 includes one or more other tools that alter material 20 in ways other than cutting. For example, tool 18 may include a scoring tool, perforation tool, engraving tool, debossing tool, foil transfer tool, or the like. While many instances, details, and references are included herein pertaining to using the roll feeder 10 in conjunction with a cutting machine, the roll feeder may be utilized in association with other material processing machines (e.g., non-cutting machines). As such, roll feeder 10 is configured for feeding material 20 into machines in general, whether cutting machines or not, where material 20 is fed into and out of the machine on a working area 16, as shown in FIG. 1.

In various embodiments, and with continued reference to FIG. 1, the roll feeder 10 is configured to be detachably coupled and/or removably secured to an open door 22 of the cutting machine 12. The door 22 of cutting machine 12 may open so that the upper surface of open door 22 forms at least a portion of the working area 16. In this open configuration, the roll feeder 10 may be positioned relative to cutting machine 12 such that material 20 from the roll 14 makes a smooth transition from the roll feeder 10 to the working area 16. Additional details pertaining to the detachable, reversible engagement between the roll feeder and a material processing machine are provided below with reference to FIGS. 3A and 3B.

Figure 2A:
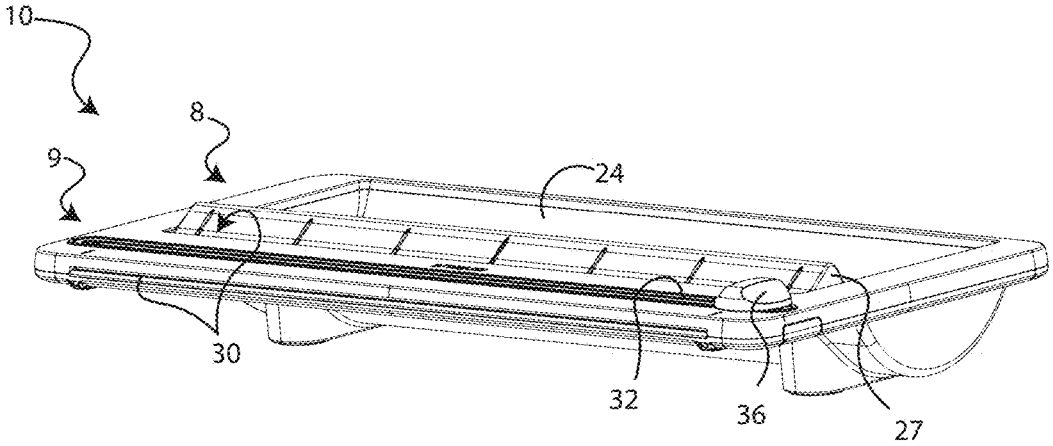
FIGS. 2A and 2B illustrate top perspective views of a roll feeder, in accordance with various embodiments.
Figure 2B:
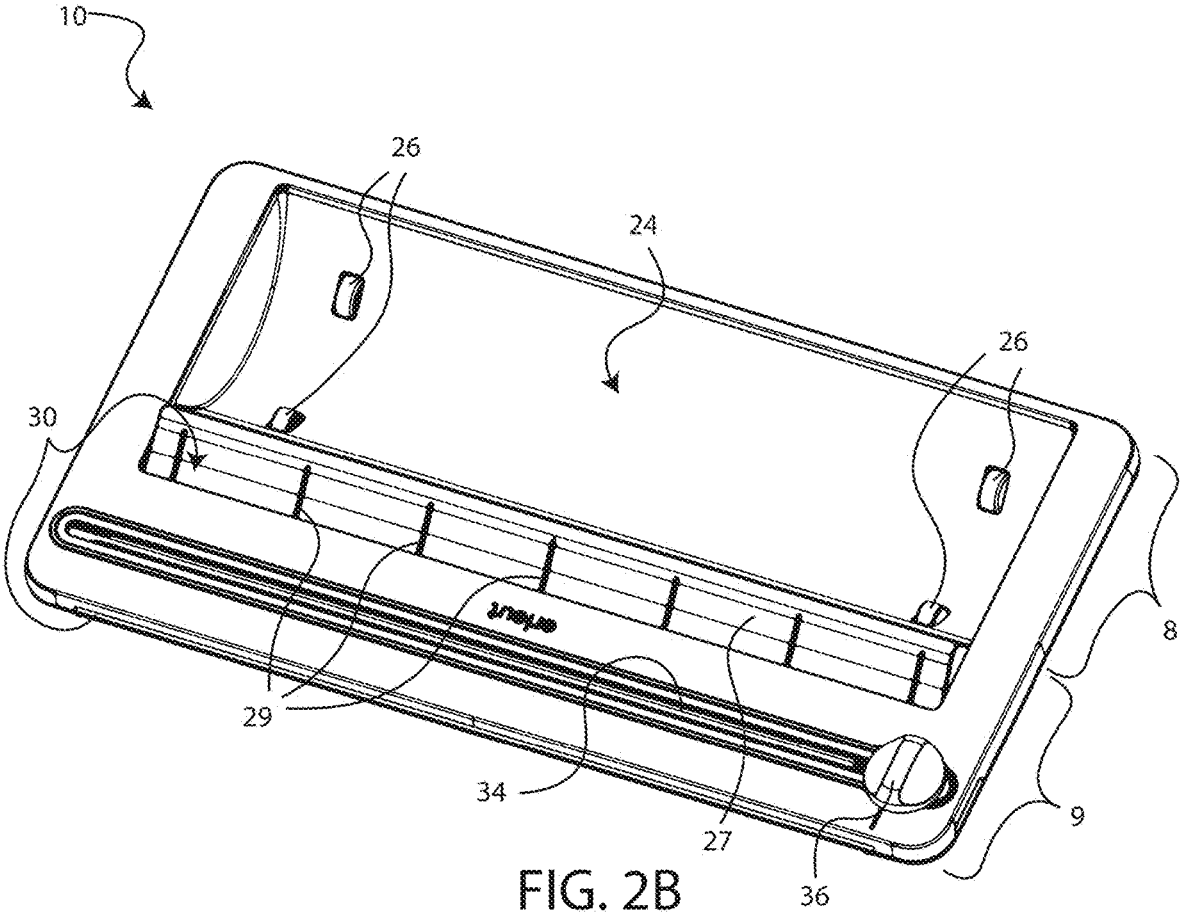
Figure 3A:
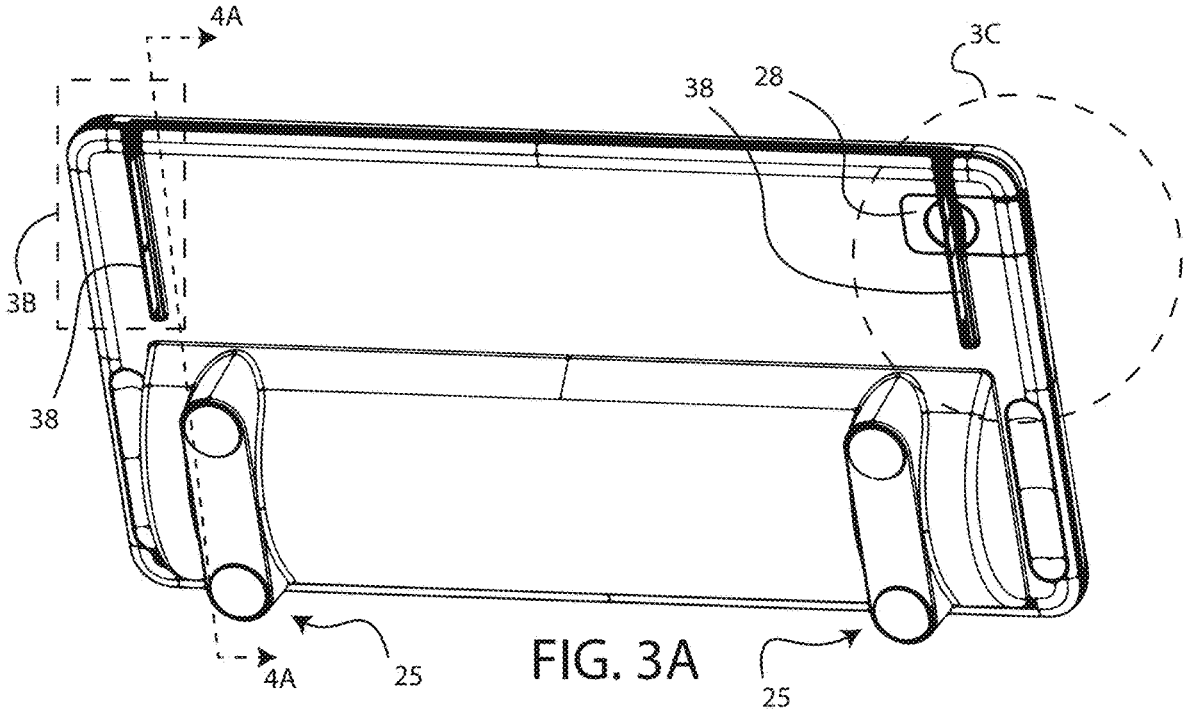
FIG. 3A illustrates a bottom perspective view of a roll feeder, in accordance with various embodiments.

FIGS. 2A, 2B, and 3A illustrate various perspective views of the roll feeder 10, according to various embodiments. The first portion 8 of the roll feeder 10 may include/define a trough 24 (e.g., semi-spherical) configured to rotatably support a roll of material, such as roll 14 shown in FIG. 1. In addition, the roll feeder 10 may include one or more rollers 26 disposed at the bottom of trough 24, which extend upward from an inner surface thereof on which roll 14 may rest and freely rotate when material 20 is drawn from roll 14 into machine 12. The one or more rollers 26 may rotate about an axis to reduce frictional resistance to a rotation of roll 14 within trough 24.

In various embodiments, two or more rollers 26 (e.g., four rollers) may be used to rotatably support the roll 14. In this way, a user can easily place a roll of material into trough 24 and remove the roll 14 when finished without any extra steps to secure the roll in trough 24. In various embodiments, rolls of material, such as roll 14 illustrated in FIG. 1, having various widths can be placed in trough 24 without any readjustment or hassle. Rolls 14 with widths less than the width of trough 24 may freely float within trough 24 but are generally centered or aligned with working area 16 of cutting machine 12 by material 20 fed into cutting machine 12, as illustrated in FIG. 1. Cutting machines of the prior art, such as that shown in FIG. 1, may include mechanisms for aligning materials fed into the cutting machine 12, such as tabs or walls extending upward from working area 16 on either side of material 20. Whatever the material alignment mechanisms of cutting machine 12 are, such mechanism are sufficient to keep the roll 14 from which the material 20 is drawn aligned/positioned correctly within trough 24. In various embodiments, the first portion of the roll feeder may have other structures, such as an elevated shaft/axis around and about which the roll rotates.

In various embodiments, the second portion 9 of the roll feeder 10 also defines a cutting slot 32 through which the material 20 may be severed. In various embodiments, the cutting slot 32 is open to the channel 30. The roll feeder may also include a severing device 36 coupled to the second portion 9 of the roll feeder 10, with at least a portion of the severing device 36 configured to operably move within and along the cutting slot 32 to sever the material 20. In various embodiments, the severing device 36 includes a cutting blade or other cutting/severing implement/tool. Cutting blade may be slidably engaged within cutting slot 32 and may be configured to slide back and forth within and along the cutting slot 32 and across the channel 30 to sever material 20 that may be disposed within the channel 30 from the roll 14. In various embodiments, the roll feeder 10 may include the severing device 36. Alternatively, in various embodiments, such a severing device is formed separately from roll feeder 10 but may be used in conjunction with roll feeder 10 and cutting machine 12.

In various embodiments, and with continued reference to FIGS. 2A, 2B, and 3A, the severing device 36 may be engaged with the structure adjacent to the cutting slot 32. For example, the severing device 36 may include a graspable handle portion that rests on a top surface of the second portion of the roll feeder 10. The handle of the severing device 36 may comprise a lower surface that glides along structure of the second portion 9 of the roll feeder 10 that is adjacent to the cutting slot 32. This structure that is adjacent the cutting slot 32 may comprise a raised rib and/or a raised standoff, thus minimizing the surface area of the interface between the handle and the second portion of the roll feeder and thereby reducing friction. In various embodiments, the interface between the cutting slot 32 and the severing device 36 comprises a detent or other temporary retention feature configured to reversibly secure the severing device 36 at either longitudinal end of the cutting slot 32, thus helping to keep the severing device 36 out of the way when not in use (e.g., during machine cutting operations as the material moves back and forth within the channel).

In various embodiments, the roll feeder 10 comprises a ramp 27 that is generally disposed between the first portion 8 and the second portion 9. The ramp 27 provides the proper downstream trajectory of the material from the roll 14 into the channel to be processed by the cutting machine, and provides a desired trajectory for a separated section of material (described below) to move over top of the roll of material. In various embodiments, the ramp 27 comprises one or more ribs 29 configured to facilitate sliding movement of the material down and along the ramp 27. In various embodiments, the peak of the ramp 27 extend above a top surface of the second portion 9 of the roll feeder 10 that defines the cutting slot 32. In various embodiments, the peak of the ramp 27 extends to the level of the rotational axis of the roll 14 of material.

Figure 3B:
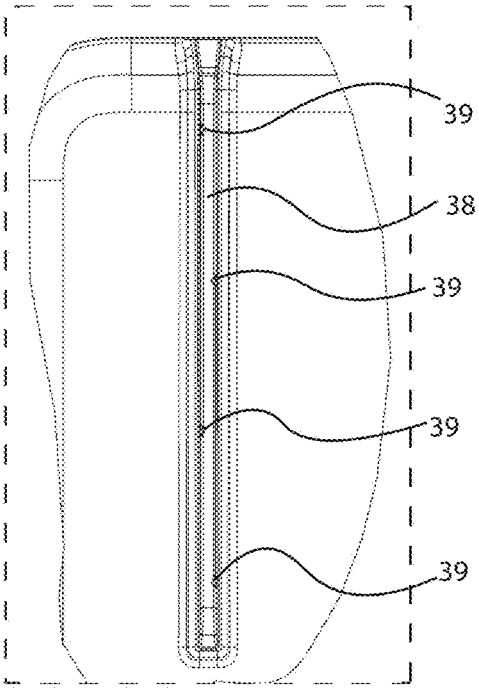
FIG. 3B illustrates a bottom view of a securement slot of the roll feeder of FIG. 3A, in accordance with various embodiments.

In various embodiments, and with specific reference to FIGS. 3A and 3B, the roll feeder 10 includes one or more feet 25 configured to stabilize the roll feeder 10 on a surface. In various embodiments, roll feeder 10 can be removably secured to cutting machine 12 via one or more securement mechanisms. The at least one securement mechanism of the roll feeder may be one of at least one engagement slot and at least one engagement rib disposed along a lower surface of the second portion of the roll feeder. Said differently, the roll feeder includes either slots or ribs and the machine to which the roll feeder can be reversibly attached has the other of the slots or the ribs. In the illustrated embodiment, the securement mechanism includes securement slots 38 disposed on lateral sides of a lower surface of the roll feeder 10. Each securement slot 38 may include a groove or channel 30 that is engageable with one or more material alignment ribs/features of cutting machine 12.

For example, cutting machines of the prior art, including cutting machine 12 shown in FIG. 1, often include one or more portions, such as raised features extending upward from the working area 16, that guide material on working area 16. In various embodiments, machine 12 may include raised walls extending along the upper surface of the open door 22 that forms a part of working area 16. The securement slots 38 of the roll feeder 10 may be disposed such that the raised alignment features of cutting machine 12 are received into securement slots 38. The slots 38 may be sized and/or otherwise configured such that a user can press securement slots 38 onto the raised alignment features so that the raised alignment features form a friction fit with the lower surface of roll feeder 10. In this way, the user can easily secure roll feeder 10 to cutting machine 12 and upon doing so, roll feeder 10 is automatically aligned appropriately with working area 16 such that material 20 being fed into cutting machine 12 from roll feeder 10 during use is aligned accurately for cutting operations.

In various embodiments, the structure of the engagement slot(s) and the engagement rib(s) may be such that certain types/vectors of relative motion between the roll feeder 10 and the machine 12 are required for coupling the two components together, with other types/vectors of relative motion required for separation the two components. For example, the engagement slot(s) 38 may be configured to slidably and longitudinally receive corresponding ribs, or the engagement slots 38 may be compressed against the ribs to retain the two components together. In various embodiments, and with specific reference to FIG. 3B, which shows an enlarged depiction of one of the engagement slots 38, opposing walls of the engagement slot may comprise tabs 39 or other protrusions that facilitate secure fit/engagement between the slot and the rib. In various embodiments, the tabs 39 are configured in the alternating fashion shown in FIG. 3B (e.g., extending from alternating walls along the longitudinal direction of the slot).

Roll feeder 10 may include one or more additional or alternative securement features to enable simple, easy securement and removal of roll feeder 10. In at least one embodiment, such securement features may include, but are not limited to, latch mechanism, clamping mechanism, magnetic mechanisms, hook-and-loop mechanisms, adhesive mechanisms, and the like. To aid a user in pressing securement slots 38 into or onto raised features of cutting machine 12, as described above, at least one embodiment of roll feeder 10 includes one or more handle portions. These handle portions provide manual gripping features to aid a user in manually securing roll feeder 10 to cutting machine 12 as well as removing roll feeder 10 therefrom.

Figure 3C:
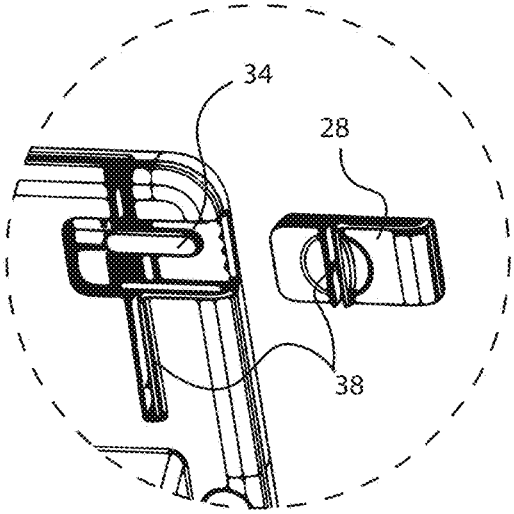
FIG. 3C illustrates a severing device access door removed a distance from the roll feeder of FIG. 3A, in accordance with various embodiments.

In various embodiments, and with reference to FIGS. 3A and 3C, the roll feeder 10 further includes a severing device access door 28. The access door 28 may be detachably secured to the roll feeder 10 to cover a blade 34 or other cutting tool of the severing device 36. When the blade 34 needs to be replaced, repaired, or otherwise manipulated, the access door 28 may be removed/detached from the roll feeder 10 (e.g., FIG. 3C), thus allowing a user to have access to the blade 34. In various embodiments, a portion of the above-described securement mechanism (e.g., a portion of one of the engagement slots 38) may be formed on the detachable access door 28. This portion of the securement mechanism may facilitate grasping of the access door 28, thus improving the ability of the user to pull and detach the access door 28 from the roll feeder 10.

Figure 4A:
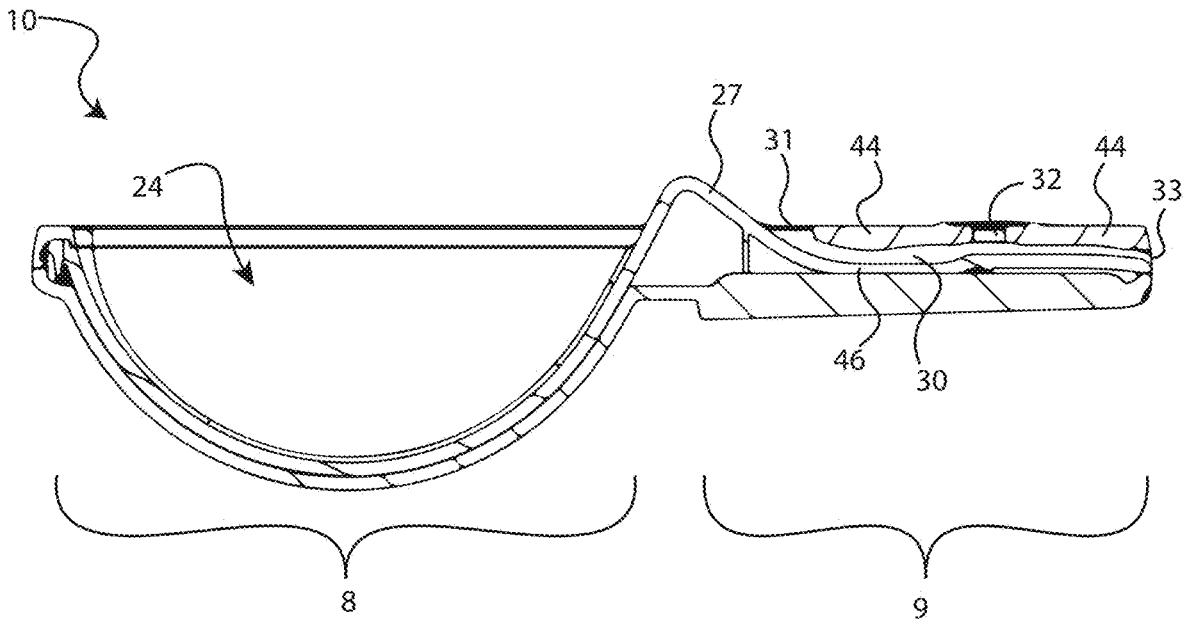
FIG. 4A illustrates a cross-sectional view, normal to and in the direction indicated by plane 4A-4A shown in FIG. 3A, of a roll feeder, in accordance with various embodiments.
Figure 4B:
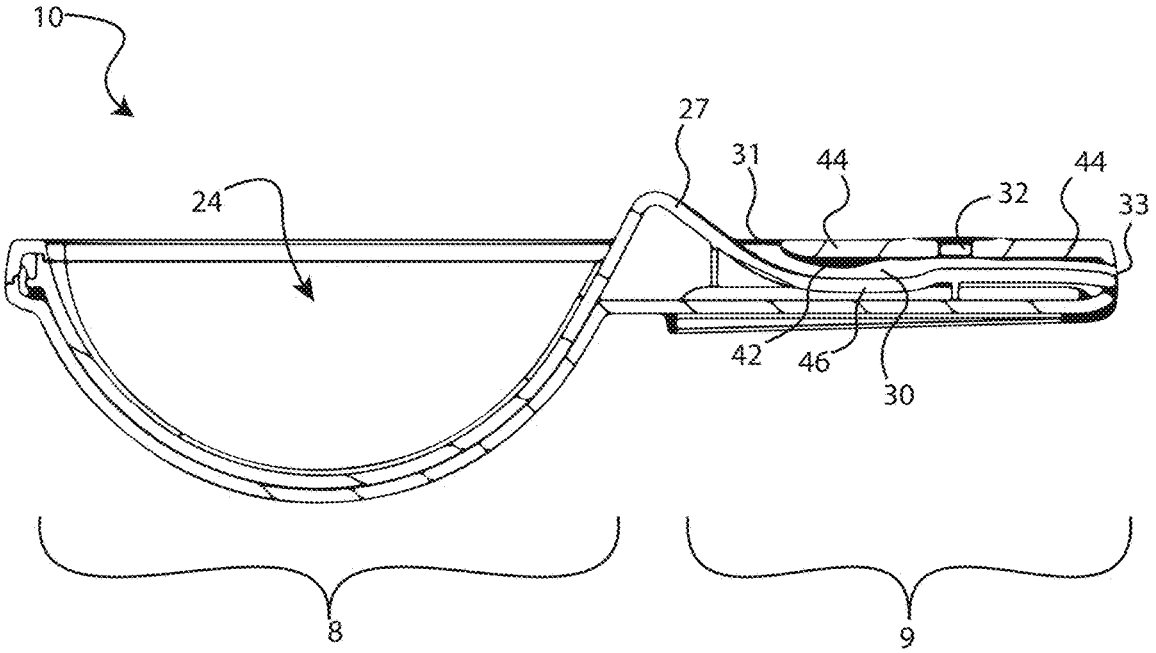
FIG. 4B illustrates a cross-sectional view of a roll feeder, in accordance with various embodiments.
Figure 4C:
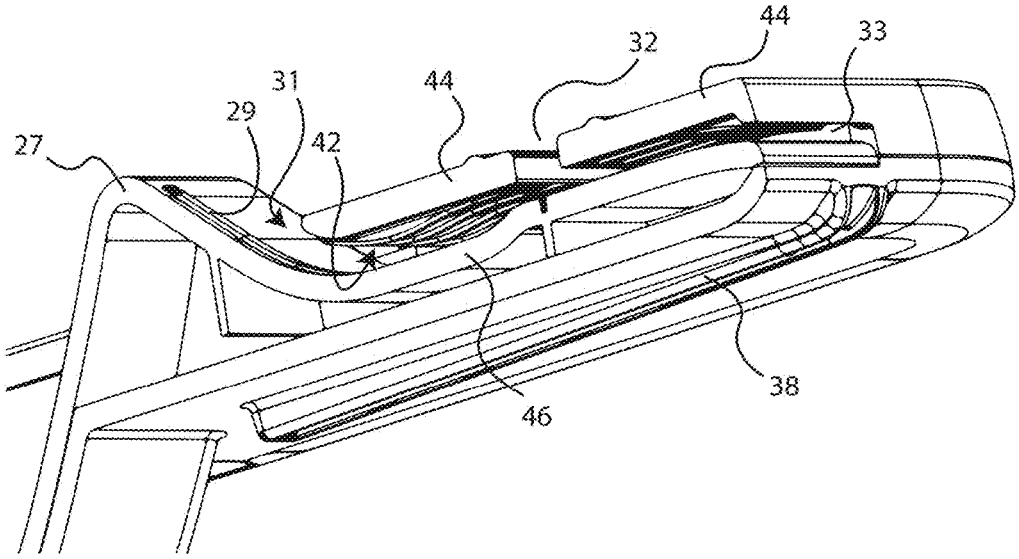
FIG. 4C illustrates a perspective cross-sectional view of a roll feeder, in accordance with various embodiments.
Figure 4D:
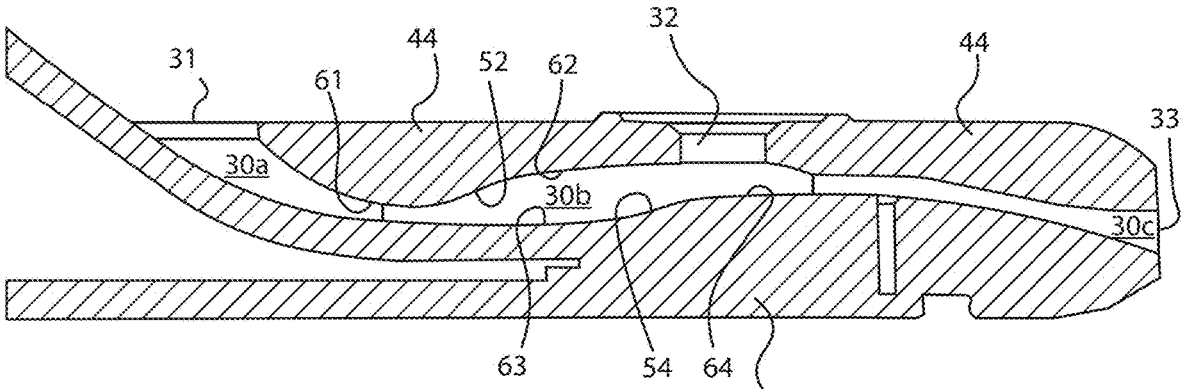
FIG. 4D illustrates an enlarged cross-sectional view of a channel of a roll feeder, in accordance with various embodiments.

In various embodiments, and with reference to FIGS. 4A, 4B, 4C, and 4D, additional details pertaining to the second portion 9 of the roll feeder 10 are provided, especially pertaining to the geometry of the channel 30. FIG. 4A is a cross-sectional view normal to plane 4A-4A indicated in FIG. 3A. FIGS. 4B, 4C, and 4D show various alternate views and/or configurations of the structure roll feeder 10. Also, for ease of reference throughout the present disclosure, the term "downstream," when used in connection with a direction and/or relative positions of components, is defined from the first portion 8 toward the second portion 9 of the roll feeder 10. Correspondingly, the term "upstream," when used in connection with a direction and/or relative positions of components, is defined from the second portion 9 toward the first portion 8 of the roll feeder 10 (i.e., opposite the downstream direction). Said differently, downstream is the direction in which material is drawn from a roll 14 in trough 24 through channel 30 while upstream is the opposite direction. During use, material is drawn downstream as it moves from roll feeder 10 to a working area 16 of a cutting machine 12. During a cutting operation, it may be necessary for the cutting machine 12 to push material back out toward and/or through channel 30, thus forcing the material to travel upstream. As described in greater detail below, the channel 30 may be specifically designed and configured such that, once the material has been processed by the machine 12, the separated/severed section of the material moves upstream and out of the channel and moves over a top surface of the roll 14 (e.g., away from the machine 12).

In various embodiments, and with continued reference to the cross-sectional views of FIGS. 4A, 4B, 4C, and 4D, the channel 30 extends between and is defined by an upper wall 44 and a lower wall 46 of the second portion 9 of the roll feeder 10. Said differently, the lower surface of the upper wall 44 defines a ceiling of the channel 30 and an upper surface of the lower wall 46 defines a floor of the channel 30. In various embodiments, although the cutting slot 32 may appear to separate upper wall 44 into two different sections, the upper wall may be a single wall with the cutting slot 32 extending therethrough.

In various embodiments, the second portion 9 of the roll feeder 10 defines a first orifice 31 and a second orifice 33. Said differently, the first orifice may be an upstream opening (e.g., inlet) to the channel 30 and the second orifice 33 may be a downstream opening (e.g., outlet) to the channel 30. Material 20 from roll 14 may pass through the channel 30 via the first and second orifices 31, 33 during use. That is, the roll feeder 10 includes first and second orifices 31, 33 that provide access for material 20 to move through a channel 30 disposed between inlet and outlet orifices 31, 33.

Regarding the shape and design of the channel 30, the second portion 9 of the roll feeder 10 (e.g., the shape and structure of the walls that define the channel 30) has a guide geometry configured to operably enable a separated section of material that has been separated/severed from the roll of material to move over a top surface of the roll of material. In various embodiments, this guide geometry comprises a shape of the channel. That is, the internal shape and direction of the channel may be configured to operably enable the separated section of material, which may be at least partially disposed within the channel 30, to exit the channel 30 and move in the upstream direction over the top surface of the material (and over the top surface of the roll 14).

In various embodiments, the shape of the channel, which may contribute to the guide geometry, comprises a plurality of convex and/or concave portions. For example, both the ceiling and the floor of the channel 30 may each include a convex portion and a concave portion. In various embodiments, and with momentary specific reference to FIG. 4D, the ceiling of the channel 30 comprises a first concave portion 62 and a first convex portion 61, with a first inflection region 52 (e.g., an inflection point, or an area where the concavity switches) between the first concave portion 62 and the first convex portion 61. Similarly, and according to various embodiments, the floor of the channel 30 may comprise a second convex portion 64 and a second concave portion 63, with a second inflection region 54 between the second convex portion 64 and the second concave portion 63.

In various embodiments, the first concave portion 62 is disposed downstream relative to the first convex portion 61. In various embodiments, the second concave portion 63 is disposed upstream of the second convex portion 64. In various embodiments, the first inflection region 52 of the ceiling is positioned upstream from the second inflection region 54 of the floor. In various embodiments, the widest portion of the channel 30 (e.g., the portion of channel which has the largest cross-sectional area) is the region between the two inflection regions 52, 54. As described in greater detail below, this region may be defined herein as a transition region 30*b* of the channel, and this transition region 30*b* may facilitate a separated section of material being able to move upstream in the channel and toward the roll of material, passing over the portion of material that is still connected to the roll and that is still disposed, at least partially, within the channel.

In various embodiments, a majority portion of the first convex portion 61 of the ceiling is offset upstream relative to the second concave portion 63 of floor and a majority portion of the first concave portion 62 of the ceiling is offset upstream relative to the second convex portion 64 of the floor. In various embodiments, the cutting slot 32, which may be open to the channel 30, is disposed downstream of the first inflection region 52. In various embodiments, the cutting slot 32 is disposed downstream of the first and second inflection regions 52, 54.

In various embodiments, and with continued reference to FIG. 4D, the channel 30 defined by the second portion 9 of the roll feeder 10 comprises a first region 30*a*, a transition region 30*b*, and a second region 30*c*. The first region 30*a* may be downstream of the first orifice 31 (e.g., the first orifice may be an upstream opening to the first region 30*a*), the transition region 30*b* may be downstream of the first region 30*a*, the second region 30*c* may be downstream of the transition region 30*b*, and the second orifice 33 may be downstream of the second region 30*c* (e.g., the second orifice 33 forming a downstream opening to the second region 30*c*). The channel 30 may generally have an S-curve shape between the first and second orifices 31, 33. In various embodiments, the first region 30*a* of the channel has a downward slant/angle, as defined relative to the downstream direction, and the second region 30*c* of the channel also has a downward angle/slant, as defined relative to the downstream direction. The intermediate transition region 30*b* may have an upward angle/slant, as defined relative to the downstream direction.

As mentioned above, the section of the channel having the largest cross-sectional area is the transition region 30*b*. The transition region 30*b*, which may be defined as the area of the channel between the two inflection regions 52, 54 of the floor/ceiling, is the location in the channel where a separated section of material (after it has been severed from the remaining material still attached to the roll of material) is able to begin moving upstream and over the other material. Additional details pertaining to the movement of the separated section of material are provided below with reference to the method steps of FIGS. 5A, 5B, 5C, 5D, and 6.

In various embodiments, and with specific reference to FIGS. 4B and 4C, the upper wall 44 comprises a contact rib 42 extending downward into the channel 30 that forms at least a portion of the ceiling of the channel 30, such that the contact rib 42 at least partially contributes to the shape of the channel. For example, the contact rib 42 may have a convex section that transitions to a horizontal section, or that transitions to a concave section. Accordingly, the contact rib 42 may form the first convex portion 61 of the ceiling of the channel. In various embodiments, the contact rib 42 also comprises the first inflection region 52 and the first concave portion 62. Said differently instead of the entire upper wall 44 having the specific guide geometry for guiding the material through the channel, one or more ribs may provide the guide geometry, thus decreasing the amount of surface area engagement between the topside of the material (which may be the finished surface of the material) and the ceiling of the channel. That is, by limiting the interfacing contact between the material (e.g., the topside of the material) and the ceiling of the channel, not only is friction reduced by the finish of the topside of the material may not be marred or damaged in response to the back and forth, repetitive motion of the material through the channel during the material processing done by the machine.

In various embodiments, continuing the concept of reducing/limiting contact between the upper wall defining the channel and the topside of the material, the contact rib may be disposed on a lateral portion of the upper wall, thus only contacting a lateral edge portion of the material being processed. Thus limiting any surface marring/scratching, if any, to these lateral edge portions of the material. In various embodiments, the contact rib comprises a first contact rib disposed on a first lateral portion of the upper wall and the roll feeder comprises a second contact rib disposed on a second lateral portion of the upper wall. In various embodiments, the first and second contact ribs are first and second sets of contact ribs. That is, a plurality of contact ribs may be disposed on opposing lateral edges of the upper wall (see FIG. 3C, which shows a plurality of ribs). The number of ribs in each lateral set of ribs may be between 2 and 10, or more.

Figure 5A:
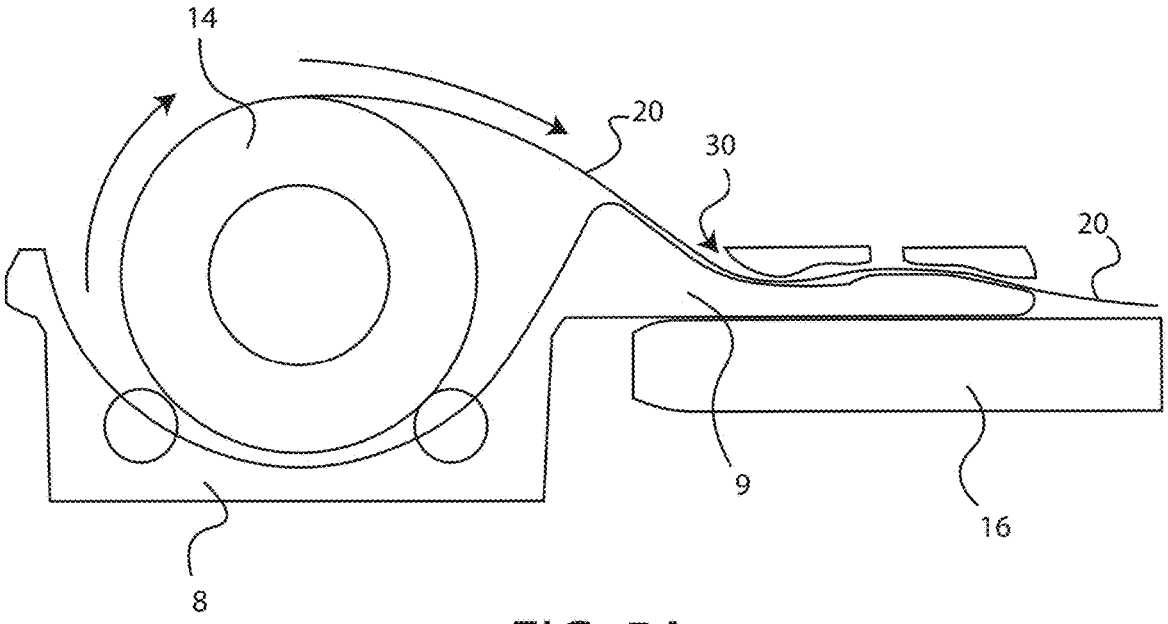
FIGS. 5A, 5B, 5C, and 5D illustrate schematic cross-sectional views of various steps of a method of operating/using a roll feeder, in accordance with various embodiments.

In order to illustrate the operational advantages of roll feeder 10 and specifically the geometry of channel 30, FIGS. 5A, 5B, 5C, and 5D show various schematic views of a method of using the roll feeder 10. As shown in FIG. 5A, material 20 from a roll 14 passes into the channel toward working area 16 of machine 12. That is, a user may rotate roll 14 as it sits in the first portion 8 of the roll feeder (e.g., disposed withing trough 24) to push material 20 through the channel 30 as shown. The arrows in FIG. 14 indicate the rotation of roll 14 as material passes through channel 30.

Once material 20 has advanced onto working area 16 of cutting machine 12, an automatic feeding mechanism, such as pinch-rollers or the like, controls the material 20, actuating it in and out. In at least one embodiment, cutting machine 12 will initially draw out as much length of material 20 as is required for a certain cutting operation.

Figure 5B:
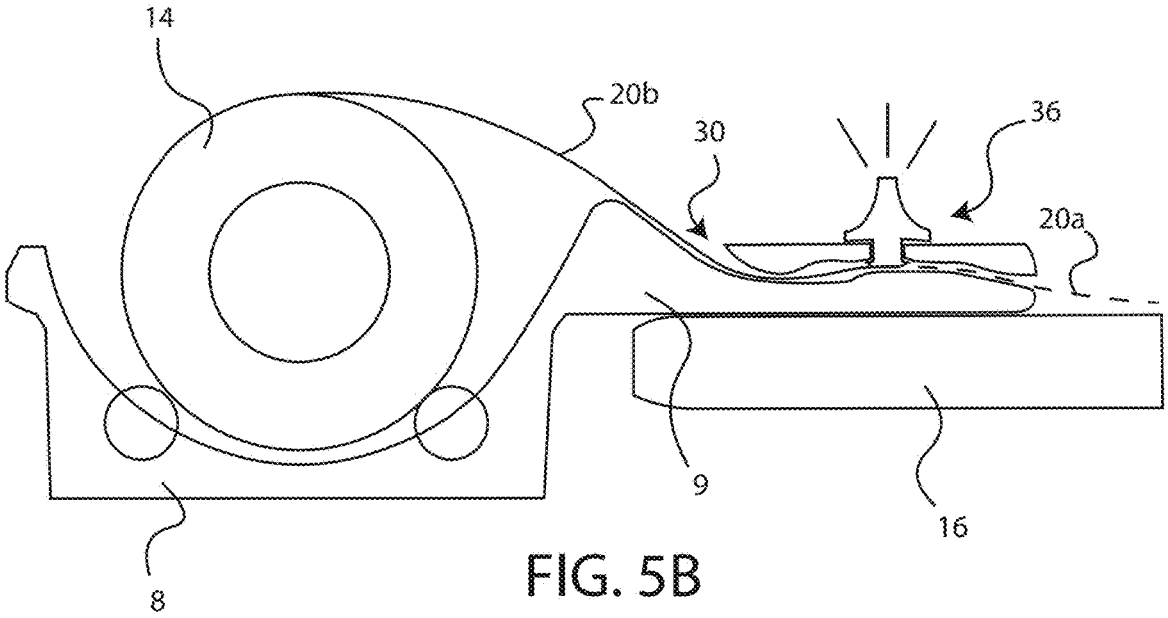

The method may further include severing the material to from a separated section 20*a* of material, as shown in FIG. 5B. Severing the material may be performed using the severing device 36. Once cut, material 20 is divided into the separated section (e.g., an independent material portion) 20*a* distinct from material 20*b*, which is still connected to roll 14. After severing independent material portion 20*a* from material 20*b*, cutting blade 34 can be moved back into its initial position so as not to interfere with movement of the material within the channel 30. The severing of the material may be performed before or after the material has been processed by the cutting machine 12. Once severed, independent material portion 20*a* can be actuated back-and-forth (i.e., into and out of cutting machine 12) as may be required by a cutting operation.

Figure 5C:
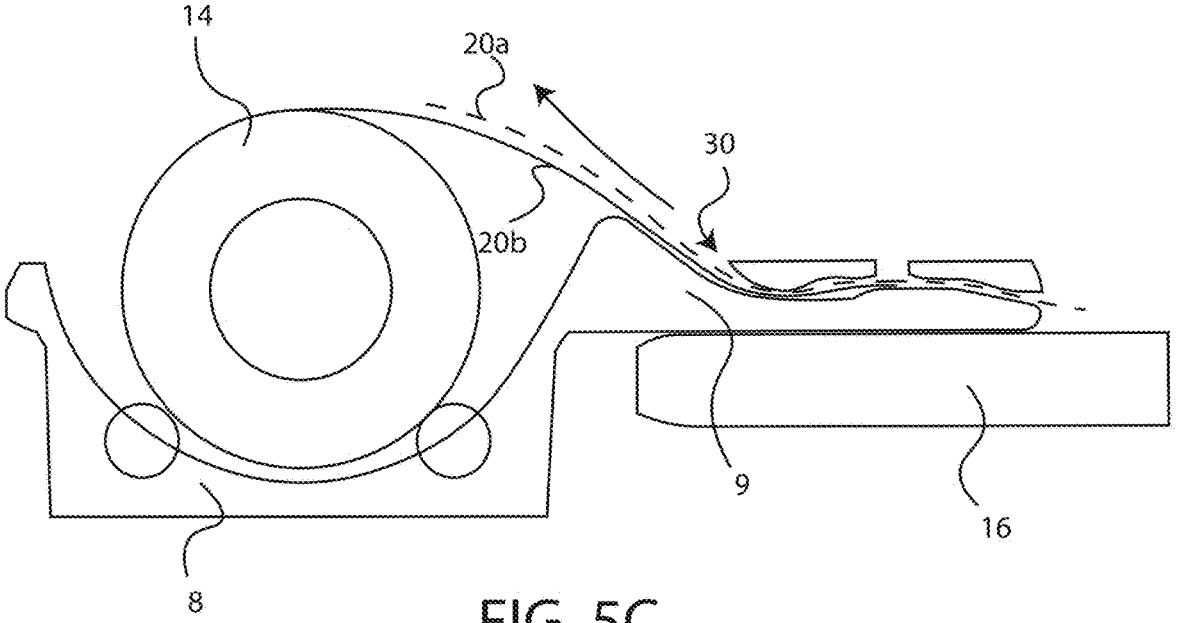

In various embodiments, and with specific reference to FIG. 5C, channel 30, including the curved ceiling and floor surfaces, guides the independent material portion 20*a* upstream over material portion 20*b*, which is still connected to roll 14. That is, due to the specific geometry of channel 30 described herein, including concave and convex portions of upper and lower surfaces, independent material 20*b*, which has some inherent stiffness, is urged from the second convex portion of the floor of the channel 30 to the first convex portion of the ceiling of the channel 30 as independent material portion 20*a* is moved upstream through channel 30. Because material portion 20*b* remains in position upstream, independent material portion 20*a* initially passes over the top of material portion 20*b* as independent material portion 20*a* moves upstream and is urged against the first convex portion of the ceiling. In this way, as independent material portion 20*a* is pushed back over material portion 20*b*, the resistance of the rotational inertia of roll 14 prevents material portion 20*b* from retreating upstream through channel 30 with independent material portion 20*a*.

As noted above, certain cutting operations may draw independent material portion 20*a* repeatedly upstream and downstream during the operation. As independent material portion 20 is drawn downstream, a frictional force between independent material portion 20*a* and material portion 20*b* may tend to draw material portion 20*b* downstream as well. However, advantageously, the second inflection region 54 of the floor of the channel 30, which may be a step-like transition, functions as a barrier to prevent material portion

20*b* still connected to roll 14 from being drawn downstream and out of channel 30 as independent material portion 20*a* moves downstream. Accordingly, in various embodiments, the cutting slot may be aligned with the second inflection region 54. In this way, during a cutting operation requiring independent material portion 20*a* being cut to move in and out of cutting machine 12, and thus upstream and downstream through channel 30, material portion 20*b* and roll 14 remain in position.

In various embodiments, independent material portion 20*a* may be long enough such that when it is pushed upstream through channel 30 and out first orifice 31, independent material portion 20*a* will slide over roll 14 and drop downward upstream from roll 14. In this way, roll 14 may act as a rounded guide to prevent independent material portion 20*a* from creasing or kinking when pushed out of cutting machine 12 after or during a cutting operation.

Figure 5D:
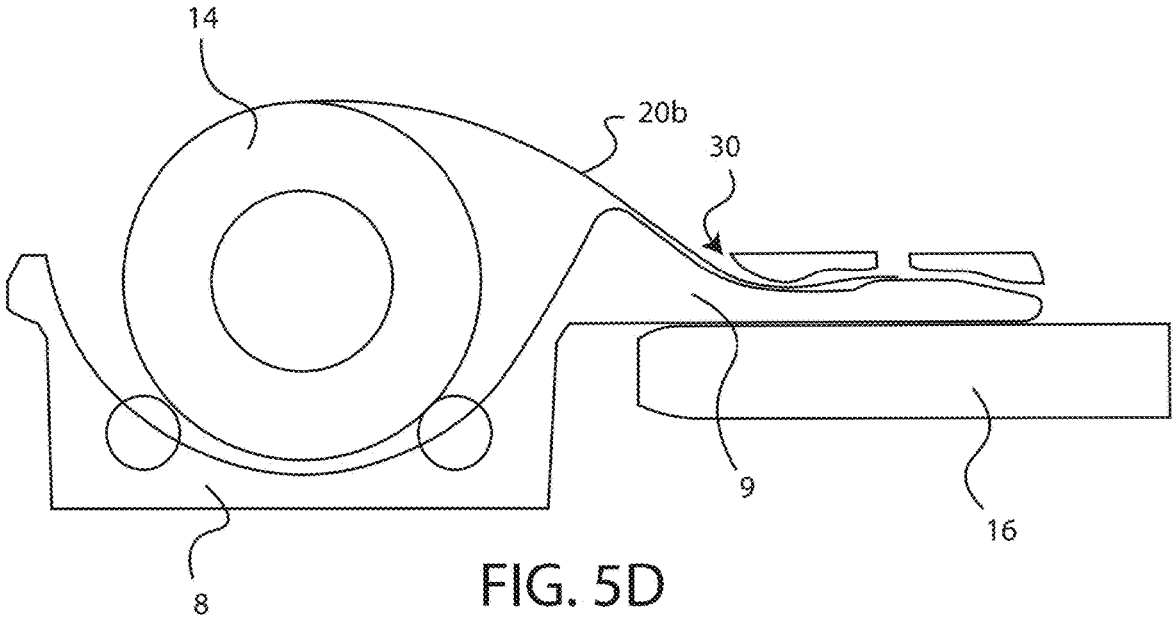

Another step of a method of operating an embodiment of a roll feeder 10 may include, once a cut or other operation has been performed on independent material portion 20*a* by cutting machine 12, a user pulling the independent material portion 20*a* back out, upstream, through channel 30. Again, this may be done without altering the position of roll 14 or material portion 20*b* still connected to roll 14, as noted above and according to various embodiments. Along these lines, FIG. 5D illustrates a complete removal of independent material portion 20*a* with roll and material portion 20*b* still in position. Advantageously, once the cutting operation is complete, the arrangement and design of roll feeder 10 described herein allows a user to remove independent material portion 20*a* from the same side of cutting machine 12 that it was initially inserted. Again, this can be done without disrupting the rest of material 20 and roll 14 so that material 20 is ready for the next cutting operation. Thus, the user does not need to have access to both sides of cutting machine 12 or move back and forth from front to back during use.

Further, a user can initialize a subsequent cutting operation by rotating roll 14 to urge material portion 20*b* over second inflection region 54 (which may defined herein as a "step") and downstream through channel 30, out second orifice 33, and onto working area 16 to being a subsequent cutting operation. Advantageously, because material portion 20*b* remains in channel 30, the user does not need to re-insert material 20 from roll 14 every time the user wants to start a cutting operation on a new portion of material 20, according to various embodiments. Instead, roll feeder 10 enables automatic material setup for positioning material 20 for new cutting operations.

Figure 6:
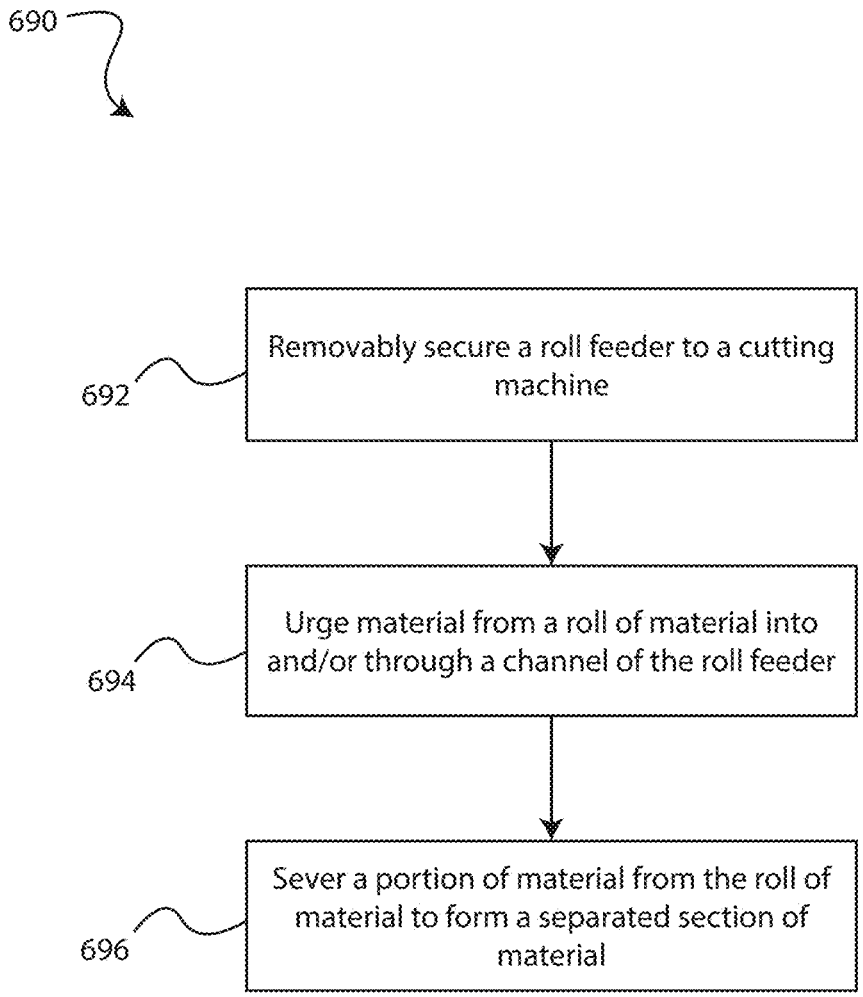
FIG. 6 is a schematic flowchart diagram showing various steps of a method of operating/using a roll feeder, in accordance with various embodiments.

FIG. 6 is a flowchart showing steps of a method 690 of operating a roll feeder, according to various embodiments. The method 690 may include removably securing a roll feeder to a cutting machine at step 692. As described above, the roll feeder may be roll feeder 10, and thus the roll feeder may include a first portion configured to detachably and rotatably support a roll of material and a second portion defining a channel. The method 690 may further include urging material from the roll of material rotatably supported by the first portion into and through the channel of the second portion of the roll feeder at step 694. Still further, the method 690 may include severing a portion of material from the roll of material to form a separated section of material at step 696. Various schematic examples of these steps are provided above with reference to FIGS. 5A, 5B, 5C and 5D, as well as various examples of the structure of the roll feeder which are provided above with reference to the earlier figures.

The method 690 may include additional steps, such as placing a roll of material into a trough 24 of roll feeder 10. Another step may include inserting material from roll 14 into a first orifice 31 of roll feeder 10. In various embodiments, step 696 includes sliding or otherwise actuating a severing device having access to material 20 inside channel 30 across material 20 to sever material as it is positioned within channel 30. In various embodiments, the method 690 further includes drawing an independent material portion 20*a* forward and backward through cutting machine 12, and thus upstream and downstream through channel 30 of roll feeder 10, during the performance of a cutting operation. Still further, the method may include removing independent material portion 20*a* by pulling independent material portion 20*a* upstream through channel 30 and away from cutting machine 12.

Figure 7A:
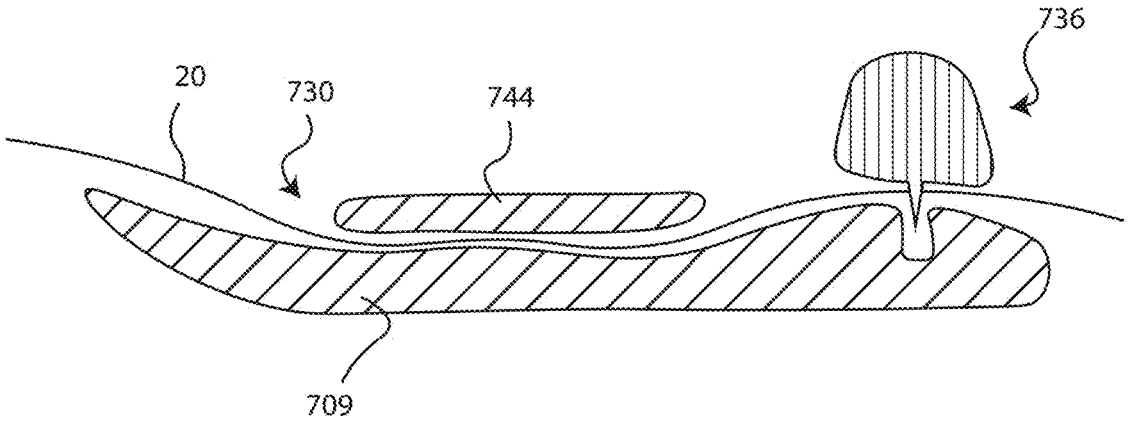
FIGS. 7A and 7B illustrate schematic cross-sectional views of a portion of a roll feeder and various steps of operating/using the roll feeder, in accordance with various embodiments.
Figure 7B:
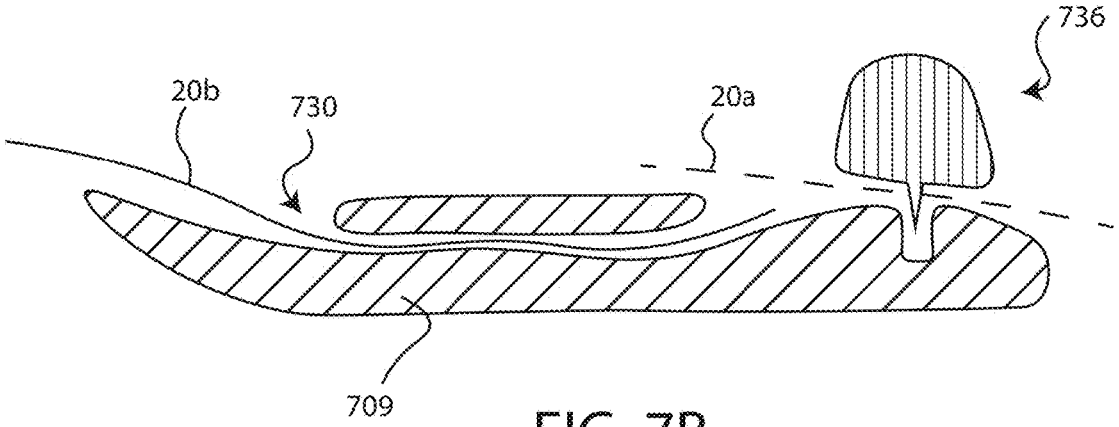

In various embodiments, and with reference to FIGS. 7A and 7B, a cross-sectional view of a portion 709 of another embodiment of a roll feeder in use is provided. In this illustrated embodiment, material 20 moves downstream through channel 730 and severing device 736 severs material 20 outside of channel 730. For example, in the illustrated embodiment, the severing device 736 is disposed downstream from second the channel 730. Once severed, independent material portion 20*a* can be fed upstream, as seen in FIG. 7B, without disturbing the position of material portion 20*b*, which is still connected to the roll of material upstream from channel 730.

In various embodiments, the portion of the roll feeder where the severing device 736 is located has a generally convex shape. This convex shape may guide independent material portion 20*b* over and outside of the channel 730 on top of upper wall 744 as independent material portion 20*a* is fed upstream by the cutting machine 12. In this way, independent material portion 20*a* does not re-enter channel 30. Once independent material portion 20*a* has been cut and removed from the cutting machine 12, material portion 20*a* still connected to the roll of material is already in position to be urged downstream, out of channel 30, and onto the working area 16 of the cutting machine 12 for the next cutting operation.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure.

Reference throughout this specification to features, advantages, or similar language does not imply that all the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. No claim element is intended to invoke 35 U.S.C. 112(f) unless the element is expressly recited using the phrase "means for."

The scope of the disclosure is to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. Further, the term "plurality" can be defined as "at least two." As used herein, the phrase "at least one of", when used with a list of items, means different combinations of one or more of the listed items may be used and only one of the items in the list may be needed. The item may be a particular object, thing, or category. Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A, B, and C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

All ranges and ratio limits disclosed herein may be combined. Numbers, percentages, ratios, or other values stated herein are intended to include that value, and also other values that are "about" or "approximately" the stated value, as would be appreciated by one of ordinary skill in the art encompassed by embodiments of the present disclosure, unless otherwise defined herein. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 10%, within 0.10%, or within 0.01% of a stated value.

Different cross-hatching may be used throughout the figures to denote different parts but not necessarily to denote the same or different materials. Surface shading lines may be used throughout the figures to denote different parts or areas but not necessarily to denote the same or different materials. In some cases, reference coordinates may be specific to each figure. Furthermore, the connecting lines shown in the various figures contained herein are intended to represent exemplary functional relationships and/or physical couplings between the various elements. It should be noted that many alternative or additional functional relationships or physical connections may be present in a practical system.

Any reference to attached, fixed, connected or the like may include permanent, removable, temporary, partial, full and/or any other possible attachment option. Additionally, any reference to without contact (or similar phrases) may also include reduced contact or minimal contact. In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The schematic flow chart diagrams included herein are generally set forth as logical flow chart diagrams. As such, the depicted order and labeled steps are indicative of one or more embodiments of the presented method. The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. Other steps and methods may be conceived that are equivalent in function, logic, or effect to one or more steps, or portions thereof, of the illustrated method.

Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown. Furthermore, no element, component, or method step in the present disclosure is intended to be dedicated to the public regardless of whether the element, component, or method step is explicitly recited in the claims.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

We claim:

1. A roll feeder comprising:

a first portion configured to rotatably support a roll of material; and a second portion defining a channel configured to receive and guide material from the roll of material therethrough;

wherein the second portion of the roll feeder is configured to be detachably coupled to a cutting machine, wherein the channel is configured to operably guide the material from the roll of material to pass through the channel to a working area of the cutting machine.

2. The roll feeder of claim 1, wherein the first portion defines trough configured to receive the roll of material.

3. The roll feeder of claim 1, wherein the second portion defines a cutting slot via which the material may be severed.

4. The roll feeder of claim 3, further comprising a severing device coupled to the second portion of the roll feeder, wherein at least a portion of the severing device is configured to operably move within and along the cutting slot to sever the material.

5. The roll feeder of claim 3, wherein the second portion of the roll feeder comprises guide geometry configured to operably enable a separated section of material that has been separated from the roll of material to move over a top surface of the roll of material.

6. The roll feeder of claim 5, wherein:

a downstream direction is defined from the first portion toward the second portion;

an upstream direction is defined from the second portion toward the first portion, opposite the downstream direction; and the cutting slot is downstream of the first portion of the roll feeder.

7. The roll feeder of claim 6, wherein the cutting slot is open to the channel.

8. The roll feeder of claim 7, wherein the guide geometry comprises a shape of the channel, wherein the shape of the channel is configured to operably enable the separated section of material that is at least partially disposed within the channel to exit the channel and move in the upstream direction over the top surface of the material.

9. The roll feeder of claim 8, wherein:

the second portion of the roll feeder comprises an upper wall and a lower wall;

a lower surface of the upper wall defines a ceiling of the channel; and an upper surface of lower wall defines a floor of the channel.

10. The roll feeder of claim 9, wherein:

the ceiling of the channel comprises a first concave portion, a first convex portion, and a first inflection region between the first convex portion and the first concave portion of the ceiling; and the floor of the channel comprises a second convex portion, a second concave portion, and a second inflection region between the second convex portion and the second concave portion of the floor.

11. The roll feeder of claim 10, wherein:

the first concave portion is disposed downstream relative to first convex portion; and the second concave portion is disposed upstream relative to the second convex portion.

12. The roll feeder of claim 11, wherein the first inflection region is disposed upstream relative to the second inflection region.

13. The roll feeder of claim 12, wherein the cutting slot is downstream of the first inflection region.

14. The roll feeder of claim 9, wherein the upper wall comprises a contact rib extending downward into the channel that forms at least a portion of the ceiling of the channel such that the contact rib at least partially contributes to the shape of the channel.

15. The roll feeder of claim 14, wherein the contact rib comprises a convex shape that transitions to a horizontal section.

16. The roll feeder of claim 14, wherein:

the contact rib comprises a first contact rib disposed on a first lateral portion of the upper wall; and the upper wall comprises a second contact rib disposed on a second lateral portion of the upper wall.

17. The roll feeder of claim 16, wherein the first contact rib is a first set of contact ribs and the second contact rib is a second set of contact ribs.

18. The roll feeder of claim 17, wherein the first set of contact ribs and the second set of contact ribs each comprises between 2 and 10 ribs.

19. The roll feeder of claim 9, wherein:

the second portion defines a first orifice as an inlet to the channel and a second orifice as an outlet to the channel;

the channel comprises a first region, a transition region, and a second region;

the first region is downstream of the first orifice, the transition region is downstream of the first region, the second region is downstream of the transition region, and the second orifice is downstream of the second region; and a cross-sectional area of the channel is greatest in the transition region.

20. A roll feeder comprising:

a first portion configured to rotatably support a roll of material; and a second portion defining a channel configured to receive and guide material from the roll of material therethrough;

wherein:

the second portion defines a cutting slot via which the material may be severed; and the second portion of the roll feeder comprises guide geometry configured to operably enable a separated section of material that has been separated from the roll of material to move over a top surface of the roll of material.

* * * * *